US005194358A

United States Patent [19]

Bayley et al.

[11] Patent Number: 5,194,358

[45] Date of Patent: Mar. 16, 1993

[54] TONER AND DEVELOPER COMPOSITIONS WITH CHARGE ENHANCING ADDITIVES

[75] Inventors: Robert D. Bayley, Fairport; Thomas R. Hoffend, Webster; Edward J. Radigan, Hamlin, all of N.Y.

[73] Assignee: Xerox Corporation, Stamford, Conn.

[21] Appl. No.: 737,288

[22] Filed: Jul. 29, 1991

[51] Int. Cl.[5] ..... B03G 9/097

[52] U.S. Cl. ..... 430/110; 430/106; 430/109

[58] Field of Search ..... 430/110, 115, 109, 106, 430/108, 111; 544/186, 185; 564/282, 290

[56] References Cited

U.S. PATENT DOCUMENTS

| | | | |
|---|---|---|---|
| Re. 32,883 | 3/1989 | Lu | 430/110 |
| 3,853,778 | 12/1974 | Buckley et al. | 252/62.1 |
| 3,936,451 | 2/1976 | Orem et al. | 260/248.5 |
| 3,965,021 | 6/1976 | Clemens et al. | 252/62.1 P |
| 4,221,856 | 9/1980 | Lu | 430/110 |
| 4,338,390 | 7/1982 | Lu | 430/106 |
| 4,394,430 | 7/1983 | Jadwin et al. | 430/110 |
| 4,560,635 | 12/1985 | Hoffend et al. | 430/106.6 |
| 4,780,388 | 10/1988 | Larson | 430/115 |
| 4,937,157 | 6/1990 | Haack et al. | 430/110 |

*Primary Examiner*—Marion E. McCamish

*Assistant Examiner*—Rosemary Ashton

*Attorney, Agent, or Firm*—E. O. Palazzo

[57] ABSTRACT

A toner composition comprised of resin particles, pigment particles, and a polysalt charge enhancing additive of the following formula wherein X is an aromatic substituent.

30 Claims, No Drawings

TONER AND DEVELOPER COMPOSITIONS WITH CHARGE ENHANCING ADDITIVES

BACKGROUND OF THE INVENTION

The invention is generally directed to toner and developer compositions, and more specifically, the present invention is directed to developer and toner compositions containing charge enhancing additives, which impart or assist in imparting a positive charge to the toner resin particles and can enable toners with rapid admix characteristics. In one embodiment, there are provided in accordance with the present invention toner compositions comprised of resin particles, pigment particles, and a charge enhancing additive comprised of the polysalt obtained by the reaction of, for example, hexamethylene tetraamine (methenamine) and an organic sulfonic acid. In one embodiment, the present invention is directed to toners with charge additives of the polysalts of the following formula:

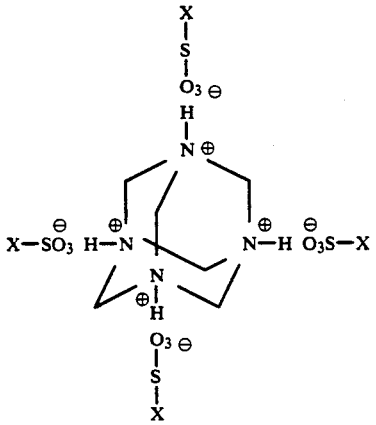

wherein X represents an aromatic group such as benzyl, tolyl, naphthyl groups, and the like, and more specifically p-toluenesulfonic acid, m-xylenesulfonic acid, p-xylenesulfonic acid, 1- and 2-naphthalenesulfonic acid, and substituted derivatives thereof.

The aforementioned additives in embodiments of the present invention enable, for example, toners with rapid admix of less than about 30 seconds, extended developer life, stable electrical properties, high image print quality with substantially no background deposits, substantial insensitivity to relative humidity of, for example, from about 20 to about 80 percent, and compatibility with fuser rolls including Viton fuser rolls. Also, the aforementioned toner compositions usually contain pigment particles comprised of, for example, carbon black, magnetites, or mixtures thereof, cyan, magenta, yellow, blue, green, red, or brown components, or mixtures thereof thereby providing for the development and generation of black and/or colored images. The toner compositions of the present invention in embodiments thereof possess, it is believed, excellent admix characteristics as indicated herein, and maintain their triboelectric charging characteristics for an extended number of imaging cycles exceeding, for example, 1,000,000 in a number of embodiments. The toner and developer compositions of the present invention can be selected for electrophotographic, especially xerographic, imaging and printing processes, including color processes.

Developer compositions with charge enhancing additives, which impart a positive charge to the toner resin, are known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchloride, tetrafluoroborate, benzene sulfonate, and the like. U.S. Pat. No. 4,221,856 discloses electrophotographic toners containing resin compatible quaternary ammonium compounds in which at least two R radicals are hydrocarbons having from 8 to about 22 carbon atoms, each other R is a hydrogen or hydrocarbon radical with from 1 to about 8 carbon atoms, and A is an anion, for example, sulfate, sulfonate, nitrate, borate, chlorate, and the halogens such as iodide, chloride and bromide, reference the Abstract of the Disclosure and column 3; a similar teaching is presented in U.S. Pat. No. 4,312,933 which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there are disclosed in U.S. Pat. No. 4,338,390, the disclosure of which is totally incorporated herein by reference, developer compositions containing as charge enhancing additives organic sulfate and sulfonates, which additives can impart a positive charge to the toner composition, and wherein the toner is compatible with, for example, Viton fuser rolls. Further, there are disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430 and 4,560,635 which illustrate a toner with a distearyl dimethyl ammonium methyl sulfate charge additive. One disadvantage that may be associated with the charge additive of the '635 patent resides in its apparent inherent instability in some instances as the additive may thermally and chemically degrade, and react with other toner components.

The following prior art, all United States patents, was listed in a patentability search report letter for U.S. Pat. No. 5,114,821, the disclosure of which is totally incorporated herein by reference; U.S. Pat. No. 4,812,381 which discloses toners and developers containing charge control agents comprising quaternary ammonium salts of the formula indicated, for example, in the Abstract of the Disclosure, wherein R is alkyl with from 12 to 18 carbon atoms, and the anion is a trifluoromethyl sulfonate; also note, for example, the information presented in columns 2 and 3 of this patent; a similar teaching is presented in U.S. Pat. Nos. 4,834,921; 4,490,455 which discloses toners with, for example, amine salt charge enhancing additives, reference the Abstract of the Disclosure for example, and wherein A is an anion including those derived from aromatic substituted sulfonic acids, such as benzene sulfonic acid, and the like, see column 3, beginning at line 33; U.S. Pat. No. 4,221,856 directed to toners with a quaternary ammonium compound wherein A is an anion such as sulfate, sulfonate, nitrate, borate, chlorate, and certain halogens, see the Abstract of the Disclosure; U.S. Pat. No. Re. 32,883 (a reissue of U.S. Pat. No. 4,338,390) illustrates toners with sulfate and sulfonate charge additives, see the Abstract of the Disclosure, wherein $R_4$ is an alkylene, and the anion contains a $R_5$ which is a tolyl group, or an alkyl group of from 1 to 3 carbon atoms, and n is the number 3; U.S. Pat. No. 4,323,634 which discloses toners with charge additives of the formulas presented in column 3, wherein at least one of the R's is a long chain amido group, and X is a halide ion or an organosulfur containing group; U.S. Pat. No. 4,326,019 relating to toners with long chain hydrazinium compounds, wherein the anion A can be a sulfate, sulfonate, phosphate, halides, nitrate, see the Abstract of the Disclosure for example; U.S. Pat. No. 4,752,550 which illustrates toners with inner salt charge additives or mixtures of charge additives, see for example column 8; U.S. Pat. No. 4,684,596 which discloses toners with charge additives of the formula provided in column 3 wherein X can be a variety of anions such as trifluoromethane sulfonate, and U.S. Pat. Nos. 4,604,338; 4,792,513; 3,893,935; 4,826,749 and 4,604,338, the disclosure of each of the aforementioned patents being totally incorporated herein by reference.

The following U.S. patents are mentioned: U.S. Pat. No. 4,812,381 relating to toners and developers with quaternary ammonium salts of the formula illustrated in column 3, the preparation thereof, see column 4, and also note the working Examples, columns 7 and 8, wherein specific charge additives, such as octadecyl ammonium trifluoromethane sulfonate, are reported; U.S. Pat. No. 4,675,118 which discloses certain quaternary salts as fabric softeners, see the Abstract of the Disclosure, and note column 1, for example, wherein X is as recited including $OSO_3CH_3$ and halide; U.S. Pat. No. 4,752,550, the disclosure of which is totally incorporated herein by reference, directed to toners and developers with inner salt charge additives and mixtures of such salts with other charge additives, see for example column 4; U.S. Pat. No. Re. 32,883 (a reissue of U.S. Pat. No. 4,338,390), the disclosures of which are totally incorporated herein by reference, wherein toners with organic sulfonate and organic sulfate charge enhancing additives are illustrated, see columns 3, 4, and 5 to 10 for example; and U.S. Pat. No. 4,058,585 which discloses a process of extracting metals with organic solvent solutions of the salts of hydrogen ionic exchange agents, and quaternary ammonium compounds. Processes for preparing quaternary ammonium salts by an ion exchange or ion pair extraction method with soluble quaternary compounds is known, reference for example *Phase Transfer Catalysis, Principles and Techniques*, Academic Press, N.Y., 1978, especially page 76, C. M. Starks, and C. Liotta, the disclosure of this textbook being totally incorporated herein by reference, and "Preparative Ion Pair Extraction", *Apotekarsocieteten/Hassle, Lakemidel*, pages 139 to 148, Sweden, 1974, the disclosure of which is totally incorporated herein by reference, which illustrates the preparation of certain bisulfates with water soluble ammonium salt reactants and a two-phase method wherein the product resides in the water phase.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

Illustrated in U.S. Pat. No. 4,937,157, the disclosure of which is totally incorporated herein by reference, are toner compositions comprised of resin, pigment or dye, and tetraalkyl, wherein alkyl, for example, contains from 1 to about 30 carbon atoms, ammonium bisulfate charge enhancing additives such as distearyl dimethyl ammonium bisulfate, tetramethyl ammonium bisulfate, tetraethyl ammonium bisulfate, tetrabutyl ammonium bisulfate, and preferably dimethyl dialkyl ammonium bisulfate compounds where the dialkyl radicals contain from about 10 to about 30 carbon atoms, and more preferably dialkyl radicals with from about 14 to about 22 carbon atoms, and the like. The aforementioned charge additives can be incorporated into the toner or may be present on the toner surface. Advantages of rapid admix, appropriate triboelectric characteristics, and the like are achieved with many of the toners of the aforementioned '157 patent. Advantages of the charge additives of the present invention in embodiments thereof over the additives of the aforementioned '157 patent include improved stable toner admix rate performance economical methods for the preparation thereof and purification thereof by a single process step; with the tetraalkyl ammonim alkyl or perfluoroalkyl sulfonates usually more acceptable thermal stability and excellent chemical stability with respect to solvolysis permitting improved shelf stability of, for example, the toner charge enhancing properties, and the like.

Quaternary ammonium bisulfates disclosed in the aforementioned '157 patent can be of the formula $R'_2R''_2N^+X^-$, wherein R' is aryl, substituted aryl such as alkylaryl, alkyl, preferably with 1to about 30 carbon atoms, such as methyl, ethyl, propyl, butyl, hexyl, heptyl, and preferably dimethyl dialkyl ammonium bisulfate compounds where the dialkyl radicals are from about 10 to about 30 carbon atoms, and more preferably dialkyl radicals with from about 14 to about 22 carbon atoms; R'' is aryl, substituted aryl such as alkylaryl, alkyl, preferably containing from 1 to about 18 carbon atoms; and $X^-$ is a bisulfate ($HSO_4$) anion. These charge control additives may be prepared by ionic exchange reactions from a variety of tetrasubstituted ammonium salts, especially those of the formula $R'_2R''_2N^+X^-$ where $X^-$ is selected from the group consisting of halide, alkyl or aryl sulfate, alkoxide, hydroxide, acetate, benzoate and phosphate; and R' and R'' are as defined herein. The tetrasubstituted ammonium salt selected can be heated in an appropriate solvent or solvents, such as water, in the presence of a stoichiometric amount of sulfuric acid. One typical process of preparation involves heating at an effective temperature of, for example, from about 40° to about 100° C. for an appropriate period of time, such as from about 5 to about 15 hours, the insoluble tetrasubstituted ammonium chloride or other halide, such as distearyl dimethyl ammonium chloride (DDACl), or the corresponding methyl sulfate salt, distearyl dimethyl ammonium methyl sulfate (DDAMS) in aqueous solution, about one molar equivalent in 85 molar equivalents of water and 10 molar equivalents of sulfuric acid in 56 molar equivalents of water. The crude product resulting after cooling to room temperature can be collected by filtration, and then purified by washing with various solvents such as acetone, followed by recrystallization from, for example, an appropriate solvent such as acetone or methanol, and the like. The resulting products can be identified by a number of techniques including melting point information, differential scanning calorimetry, infrared spectra, carbon, and proton nuclear magnetic resonance, ion chromotography, elemental analysis, and the like.

Processes for the preparation of quaternary ammonium bisulfate charge enhancing additives are illustrated in copending application U.S. Ser. No. 396,497 entitled "Quaternary Ammonium Compounds and Processes Thereof", with the listed inventor John L. Haack, the disclosure of which is totally incorporated herein by reference. Also, toner compositions comprised of a mixture of charge enhancing additives wherein one of hte additives can be the above bisulfate and processes thereof are illustrated in U.S. Pat. No. 4,904,762, the disclosure of which is totally incorporated herein by reference.

Process embodiments illustrated in the aforementioned copending application and U.S. patent for the preparation of the bisulfate charge additives include the reaction of water insoluble quaternary ammonium salts, such as distearyl dimethyl ammonium methyl sulfate; distearyl dialkyl ammonium halides, such as distearyl dimethyl ammonium halide, especially the chloride or bromide; dialkyl distearyl ammonium hydroxides, wherein alkyl contains from 10 to about 30 carbon atoms, such as dimethyl distearyl ammonium hydroxide, and diethyl distearyl ammonium hydroxide; distearyl ammonium tosylate, such as dimethyl distearyl ammonium tosylate; distearyl dialkyl, wherein alkyl, for example, contains from 1 to about 30 carbon atoms; ammonium alkyl, wherein alkyl, for example, contains from 1 to about 20 carbon atoms; sulfonate; and the like with a sulfuric acid in the presence of heat. Usually a solvent for the acid, such as water, is selected. The acid is selected in effective amounts of, for example, from about 1 to about 10 molar equivalents, and preferably from about 5 to about 8 molar equivalents to about 1 molar equivalent of the quaternary ammonium salt reactant. Heating of the reaction mixture can be accomplished at various temperatures depending, for example, on the reactants selected, preferably the reaction, however, is accomplished at a temperature of from about 40° to about 100° C. Distearyl dimethyl ammonium methyl sulfate can be heated in an appropriate solvent or solvent mixture in the presence of stoichiometric amount of sulfuric acid. The solvent system comprised, for example, of water, water and alcohol mixtures, water and tetrahydrofuran mixtures, water and acetone mixtures, and water and halogenated, especially chlorinated, solvent mixtures may be selected permitting a single phase or two phase system to facilitate the speed thereof by, for example, from days to hours of the reaction and enabling the isolation and purification of the desired quaternary ammonium product. In the one phase method, for example, there is dissolved the DDAMS quaternary ammonium salt reactant and the concentrated sulfuric acid, water, a water miscible organic cosolvent including acetone, dioxane, glycol ethers, tetrahydrofuran, or an aqueous alcohol, preferably methanol or tetrahydrofuran. Thereafter, the resulting solution can be heated, followed by cooling whereby a precipitate of the desired bisulfate product is obtained subsequent to isolation by filtration. The product may be purified by, for example, known recrystallization methods. With a two-phase process, the appropriate quaternary ammonium salt in a solvent such as methylene chloride or chloroform is mixed and heated with an aqueous sulfuric acid solution. One preferred two-phase method comprises heating the appropriate powdered DDAMS quaternary ammonium salt reactant in suspension with excess aqueous sulfuric acid. In the aforementioned two-phase methods, the desired bisulfate product can be isolated directly by filtration, and thereafter purified by recrystallization, or other similar methods when desirable. The resulting products obtained with the process of the present invention can be identified by a number of techniques including melting point information, differential scanning calorimetry, infrared spectra, carbon, and proton nuclear magnetic resonance, ion chromotography, elemental analysis, and the like.

Illustrated in U.S. Pat. No. 5,082,758, the disclosure of which is totally incorporated herein by reference, are toners with triflate charge enhancing additives.

Although many charge enhancing additives are known, there continues to be a need for toners with additives, which toners possess many of the advantages illustrated herein. Additionally, there is a need for positive charge enhancing additives which are useful for incorporation into black and/or colored toner compositions. Moreover, there is a need for colored toner compositions containing certain charge enhancing additives. There is also a need for toner compositions with certain charge enhancing additives, which toners in embodiments thereof possess acceptable substantially stable triboelectric charging characteristics, compatibility with fuser rolls, such as Viton fuser rolls, humidity insensitivity, and excellent admixing properties. Moreover, there continues to be a need for positively charged toner and developer compositions. There also is a need for positively charged black, and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for toner compositions which have the desired triboelectric charge level, for example, from about 10 to about 40 microcoulombs per gram, and preferably from about 10 to about 25 microcoulombs per gram.

SUMMARY OF THE INVENTION

It is an object of the present invention to provide toner and developer compositions with charge enhancing additives.

In another object of the present invention there are provided positively charged toner compositions useful for the development of electrostatic latent images including color images.

In yet another object of the present invention there are provided positively charged toner compositions containing as charge enhancing additives polysalt components obtained from the reaction of a hexamethylene tetraamine and an organic sulfonic acid wherein X represents an aromatic group such as benzyl, tolyl and naphthyl groups, and more specifically p-toluenesulfonic acid, m-xylenesulfonic acid, p-xylenesulfonic acid, 1- and 2-naphthalenesulfonic acid, and substituted derivatives thereof.

Also, in another object of the present invention there are provided developer compositions with positively charged toner particles, and carrier particles.

In yet a further object of the present invention there can be provided, it is believed, humidity insensitive, from about, for example, 20 to 80 percent relative humidity at temperatures of from 60° to 80° F. as determined in a relative humidity testing chamber, positively charged toner compositions with acceptable triboelectric charging characteristics of from about 10 to about 40 microcoulombs per gram.

Additionally, in a further object of the present invention there are provided positively charged magnetic toner compositions, and positively charged colored toner compositions containing therein, or thereon the charge enhancing additives of the Formula illustrated herein.

In another object of the present invention that are provided thermally stable charge enhancing additives, that is for example additives which do not decompose at high temperatures, for example, of from about 130° to about 160° C.

Another object of the present invention resides in the formation of toners which may, it is believed, enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies per minute.

These and other objects of the present invention can be accomplished in embodiments thereof by providing toner compositions comprised of resin particles, pigment particles, and polysalt charge enhancing additives. More specifically, the present invention in one embodiment is directed to toner compositions comprised of resin, pigment, or dye, and a charge enhancing additive of the Formula illustrated herein, wherein X represents an aromatic group with, for example, from 6 to about 28 carbon atoms, such as benzyl, tolyl, naphthyl, and the like, and more specifically p-toluenesulfonic acid, m-xylenesulfonic acid, p-xylenesulfonic acid, 1- and 2-naphthalenesulfonic acid, and substituted derivatives thereof. The aforementioned charge additive can be incorporated into the toner, may be present on the toner surface, or may be present on toner surface additives such as colloidal silica particles. Advantages of rapid admix may, it is believed, be achievable, appropriate triboelectric characteristics, and the like are achieved with many of the aforementioned toners of the present invention. Also, the toners of the present invention may contain mixtures of the aforementioned charge additive with other charge additives such as distearyl dimethyl ammonium methyl sulfate, the bisulfates, and charge additives of the copending application U.S. Ser. No. 396,497 and U.S. Pat. Nos. 4,904,762 and 4,937,157, the disclosures of which are totally incorporated herein by reference, the charge additives of the patents mentioned herein, and the like. With mixtures, from about 0.05 to about 1.0 percent by weight of the charge enhancing additive of the present invention can be selected, and from about 0.05 to about 1.0 percent of a second charge enhancing additive can be selected for the toners in embodiments of the present invention. Other amounts of mixtures may also be selected in embodiments of the present invention.

In another embodiment of the present invention there are provided, subsequent to known micronization and classification, toner particles with an average diameter of from about 10 to about 20 microns comprised of resin particles, pigment particles, and the charge enhancing additives of the Formula illustrated herein.

Examples of specific second charge additives selected include, for example, bisulfate charge enhancing additives such as trialkyl hydrogen ammonium bisulfate such as distearyl methyl hydrogen ammonium bisulfate, trimethyl hydrogen ammonium bisulfate, triethyl hydrogen ammonium bisulfate, tributyl hydrogen ammonium bisulfate, dioctyl methyl hydrogen ammonium bisulfate, didodecyl methyl hydrogen ammonium bisulfate, dihexadecyl methyl hydrogen ammonium bisulfate, and the like; and preferably in an embodiment distearyl methyl hydrogen ammonium bisulfate. Examples of tetraalkyl ammonium sulfonate charge additives include distearyl dimethyl ammonium methyl sulfonate, trifluoromethyl sulfonate, tetramethyl ammonium methyl sulfonate, tetramethyl ammonium trifluoromethyl sulfonate, tetrabutyl ammonium methyl sulfonate, tetrabutyl ammonium trifluoromethyl sulfonate, dioctyl dimethyl ammonium methyl sulfonate, dioctyl dimethyl ammonium trifluoromethyl sulfonate, didodecyl dimethyl ammonium methyl sulfonate, didodecyl dimethyl ammonium trifluoromethyl sulfonate, dihexadecyl dimethyl ammonium methyl sulfonate, dihexadecyl dimethyl ammonium trifluoromethyl sulfonate, and the like; and preferably distearyl methyl hydrogen ammonium bisulfate or distearyl dimethyl trifluoromethyl sulfonate.

Examples of specific polysalt charge additives selected for the toners of the present invention include hexamethylene tetraamine tetratoluene sulfonate, hexamethylene tetraamine tetraxylene sulfonate, hexamethylene tetraamine tetranaphthalene sulfonate, hexamethylenetetraamine tetrabenzene sulfonate, and the like.

A typical preparation of a polysalt such as the toluene sulfonate of hexamethylene tetraamine is as follows:

In an 8 liter jacketed glass reaction kettle equipped with stainless stirrer were added 4 liters of isopropanol, and 230.55 grams (1.21 moles) of p-toluenesulfonic acid. Upon solution, the mixture temperature was increased to reflux (aproximately 83° C.), and 42.48 grams (0.3 moles) of hexamethylene tetraamine was added. The mixture was allowed to react in the glass reaction kettle over a period of 24 hours to produce the tetratoluene sulfonate salt of hexamethylene tetraamine named (TATTOS). After cooling the reaction media to room temperature, about 23° C., the product was filtered through a coarse buchner funnel and washed with cold clean isopropanol to remove residual p-toluenesulfonic acid. Drying in a vacuum oven overnight at 35° provided a white crystalline product. The product was found to have a melting point of about 341° C. when it decomposed. Characterization by IR showed disappearance of amine functionality of the hexamethylene tetraamine and presence of a polysulfonate salt to varify the existence of hexamethylene tetraamine tetratoluene sulfonate.

The toner compositions of the present invention can be prepared by a number of known methods, such as admixing and heating resin particles such as styrene butadiene copolymers, pigment particles such as magnetite, carbon black, or mixtures thereof, and preferably from about 0.5 percent to about 5 percent of the aforementioned charge enhancing additive, or mixtures of charge additives, in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from between about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Illustrative examples of suitable toner resins selected for the toner and developer compositions of the present invention include polyamides, polyolefins, styrene acrylates, styrene methacrylates, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Monomers include styrene, p-chlorostyrene, saturated mono-olefins such as ethylene, propylene, butylene, isobutylene and the like; unsaturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide, mixtures thereof; and the like. Specific toner resins include styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, and homopolymers of the aforementioned styrene polymers may be selected.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; PLIOLITES®; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a molecular weight of from about 500 to about 6,000, such as polyethylene, polypropylene, UNILIN TM hydroxy alcohols and paraffin waxes, can be included in, or on the toner compositions as fuser roll release agents.

The resin particles are present in a sufficient, but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive of the present invention may be coated on the pigment particle. When used as a coating, the charge enhancing additive of the present invention is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black, such as REGAL 330®, BLACK PEARLS®, VULCAN®, commercially available, nigrosine dye, aniline blue, magnetite, or mixtures thereof. The pigment, which is carbon black in an embodiment, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected.

When the pigment particles are comprised of magnetites, thereby enabling single component toners in some instances, which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as Mapico Black, in an amount of, for example, from about 5 to about 60, and preferably from about 10 to about 50 weight percent can be selected.

There can also be blended with the toner compositions of the present invention external additive particles including flow aid additives, which additives are usually present on the surface thereof. Examples of these additives include colloidal silicas such as AEROSIL®, metal salts and metal salts of fatty acids inclusive of zinc stearate, aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, surface additives such as colloidal silicas such as AEROSIL ® can be surface treated with the charge additives of the present invention illustrated herein in an amount of from about 1 to about 30 weight percent and preferably 10 weight percent, followed by the addition thereof to the toner in an amount of from 0.1 to 10 and preferably 0.1 to 1 weight percent.

There can be included in the toner compositions of the present invention low molecular weight waxes, such as polypropylenes and polyethylenes commercially available from Allied Chemical and Petrolite Corporation, Epolene N-15 commercially available from Eastman Chemical Products, Inc., Viscol 550-P, Viscol 660-P, low weight average molecular weight polypropylene available from Sanyo Kasei K.K., and similar materials. The commercially available polyethylenes selected have a molecular weight of from about 1,000 to about 1,500, it is believed, while the commercially available polypropylenes utilized for the toner compositions of the present invention are believed to have a molecular weight of from about 4,000 to about 7,000. Many of the polyethylene and polypropylene compositions useful in the present invention are illustrated in British Patent No. 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Encompassed within the scope of the present invention are colored toner and developer compositions comprised of toner resin particles, optional carrier particles, the polysalt charge enhancing additives illustrated herein, and as pigments or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthracene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention can be selected to be of a negative polarity enabling the toner particles, which are positively charged, to adhere to and surround the carrier particles. Illustrative examples of carrier particles include iron power, steel, nickel, iron, ferrites, including copper zinc ferrites, and the like. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances, such as carbon black, in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR ® and polymethyl methacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000, and preferably about 275 microns thereby permitting them to possess sufficient density and inertia to avoid adherence to the electrostatic images during the development process. The carrier component can be mixed with the toner composition in various suitable combinations, however, in an embodiment about 1 to 5 parts per toner to about 100 parts to about 200 parts by weight of carrier are selected.

The toner composition of the present invention can be prepared by a number of known methods as illustrated herein including extrusion melt blending the toner resin particles, pigment particles or colorants, the change enhancing additive and other components as indicated herein, followed by mechanical attrition and classification. Other methods include those well known in the art such as spray drying, melt dispersion, extrusion processing, dispersion polymerization, and suspension polymerization.

The toner and developer compositions of the present invention may be selected for use in electrostatographic imaging apparatuses containing therein conventional photoreceptors providing that they are capable of being charged negatively in embodiments thereof. Thus, the toner and developer compositions of the present invention can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other similar photoreceptors can be selected. Discharge area development may also be selected.

The toner compositions are usually jetted and classified subsequent to preparation to enable toner particles with a preferred average diameter of from about 5 to about 25 microns, and more preferably from about 8 to about 12 microns. Also, the toner compositions of the present invention possess a triboelectric charge of from about 0.1 to about 2 femtocoulombs per micron in embodiments thereof as determined by the known charge spectrograph. Admix time for the toners of the present invention can, it is believed, be from about 5 seconds to 1 minute, and more specifically from about 5 to about 15 seconds in embodiments thereof as determined by the known charge spectrograph. These toner compositions with rapid admix characteristics can enable, for example, the development of images in electrophotographic imaging apparatuses, which images have substantially no background deposits thereon, even at high toner dispensing rates in some instances, for example exceeding 20 grams per minute; and further, such toner compositions can be selected for high speed electrophotograpic apparatuses, that is those exceeding 70 copies per minute.

When the charge additives of the present invention are utilized in admixtures with other additives, for example alkyl pyridinium halides, organic sulfates, organic sulfonates, bisulfates, distearyl dimethyl ammonium methyl sulfate, and the like, generally there is present in the mixture an effective amount of each additive, such as for example from about 30 to about 80 percent by weight of the first additive of the present invention, and from about 20 to about 70 weight percent of the second charge additive in an embodiment of the present invention; from about 40 to about 60 percent by weight of the first additive of the present invention, and from about 60 to about 40 weight percent of the second charge additive in another embodiment of the present invention.

The following Examples are being supplied to further define various species of the present invention, it being noted that these Examples are intended to illustrate and not limit the scope of the present invention. Parts and percentages are by weight unless otherwise indicated.

EXAMPLE I

In an 8 liter jacketed glass reaction kettle equipped with stainless stirrer were added 4 liters of isopropanol, and 230.55 grams (1.21 moles) of p-toluenesulfonic acid. Upon solution, the mixture was raised to reflux (approximately 83° C.), and 42.48 grams (0.3 moles) of hexamethylene tetraamine was added. The mixture was allowed to react in the glass reaction kettle over a period of 24 hours to produce the tetratoluene sulfonate salt of hexamethylene tetraamine named (TATTOS). After cooling the reaction media to room temperature, about 23° C., the product was filtered through a coarse buchner funnel and washed with cold clean isopropanol to remove residual p-toluenesulfonic acid. Drying in a vacuum oven overnight at 35° provided a white crystalline product. The product was found to have a melting point of about 341° C. when it decomposed. Characterization by IR showed disappearance of amine functionality of the hexamethylene tetraamine and presence of a polysulfonate salt to varify the existence of hexamethylene tetraamine tetratoluene sulfonate.

EXAMPLE II

There was prepared in an extrusion device, available as ZSK28 from Werner Pfleiderer, a toner composition by adding thereto 80.13 percent by weight of suspension polymerized styrene butadiene copolymer resin particles (87/13), reference U.S. Pat. No. 4,558,108, the disclosure of which is totally incorporated herein by reference; 16.4 percent by weight the magnetite Mapico Black; 3.15 percent by weight of Regal 330® carbon black; and 1.0 percent by weight of the charge enhancing additive TATTOS obtained from Example I. The toner product which was extruded at a rate of 15 pounds per hour reached a melting temperature of 382° F. The strands of melt mixed product exiting from the extruder were cooled by immersing them in a water bath maintained at room temperature, about 25° C. Subsequent to air drying, the resulting toner was subjected to grinding in a Sturtevant micronizer enabling particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns.

Subsequently, the above formulated toner, 3 parts by weight, was mixed with 97 parts by weight of a carrier containing a steel core with a polymer mixture thereof, 0.70 percent by weight, which polymer mixture contained 60 parts by weight of polyvinylidene fluoride, and 40 parts by weight of polmethylmethacrylate, and wherein mixing was accomplished in a paint shaker for 10 minutes. There resulted on the toner composition, as determined in the known Faraday Cage apparatus, a positive triboelectric charge of 14 microcoulombs per gram.

EXAMPLE III

There was prepared in an extrusion device, available as ZSK28 from Werner Pfleiderer, a toner composition by adding thereto 80.13 percent by weight of suspension polymerized styrene butadiene copolymer resin particles (87/13), reference U.S. Pat No. 4,558,108, the disclosure of which is totally incorporated herein by reference; 16.4 percent by weight of the magnetite Mapico Black; 3.15 percent by weight of Regal 330® carbon black; and 2.0 percent by weight of the charge enhancing additive TATTOS obtained from Example I. The toner product which was extruded at a rate of 15 pounds per hour reached a melting temperature of 382° F. The strands of melt mixed product exiting from the extruder were cooled by immersing them in a water bath maintained at room temperature, about 25° C. Subsequent to air drying, the resulting toner was subjected to grinding in a Sturtevant micronizer enabling particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns.

Subsequently, the above formulated toner, 3 parts by weight, was mixed with 97 parts by weight of a carrier containing a steel core with a polymer mixture thereof, 0.70 percent by weight, which polymer mixture contained 80 parts by weight of polyvinylidene fluoride, and 20 parts by weight of polymethylmetharcylate, and wherein mixing was accomplished in a paint shaker for 10 minutes. There resulted on the toner composition, as determined in the known Faraday Cage apparatus, a positive triboelectric charge of 29.6 microcoulombs per gram.

Other modifications of the present invention may occur to those skilled in the art subsequent to a review of the present application, and these modifications, including equivalents thereof, are intended to be included within the scope of the present invention.

What is claimed is:

1. A dry positively charged toner composition consisting essentially of resin particles, pigment particles, and a polysalt charge enhancing additive of the following formula

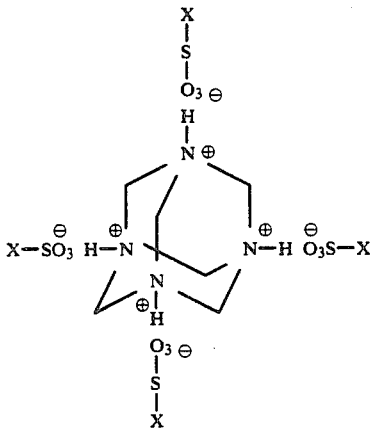

wherein X is an aromatic substituent.

2. A toner in accordance with claim 1 wherein the aromatic substituent contains from 6 to about 24 carbon atoms.

3. A toner composition in accordance with claim 2 wherein the charge additive is present in an amount of from about 0.05 to about 5 weight percent.

4. A toner in accordance with claim 1 wherein the aromatic substituent is tolyl.

5. A toner composition in accordance with claim 4 wherein the charge additive is present in an amount of from about 0.1 to about 3 weight percent.

6. A toner composition in accordance with claim 4 with a triboelectric charge of from about 10 to about 40 microcoulombs per gram.

7. A toner composition in accordance with claim 4 wherein a colloidal silica is treated with the charge enhancing additive, and the resulting composition is present on the surface of the toner.

8. A developer composition comprises of the toner composition of claim 4 and carrier particles.

9. A method of imaging which comprises formulating an electrostatic latent image on a negatively charged photoconductor, affecting development thereof with the toner composition of claim 4, and thereafter transferring the developed image to a suitable substrate.

10. A toner composition in accordance with claim 1 wherein the charge additive is incorporated into the toner.

11. A toner composition in accordance with claim 1 wherein the charge additive is present on the surface of the toner composition.

12. A toner composition in accordance with claim 1 wherein the resin particles are comprised of styrene polymers, polyesters, or mixtures thereof.

13. A toner composition in accordance with claim 1 wherein the resin particles are comprises of styrene acrylates, styrene methacrylates, or styrene butadienes.

14. A toner composition in accordance with claim 1 containing a wax component with a weight average molecular weight of from about 500 to about 7,000.

15. A toner composition in accordance with claim 14 wherein the waxy component is selected from the group consisting of polyethylene and polypropylene.

16. A toner composition in accordance with claim 1 wherein the pigment particles are carbon black, magnetites, or mixtures thereof, cyan, magenta, yellow, red, blue, green, brown, or mixtures thereof.

17. A toner composition in accordance with claim 16 wherein the charge additive is present in an amount of from about 0.05 to 5 weight percent.

18. A toner composition in accordance with claim 1 containing as external additives metal salts of a fatty acid, colloidal silicas, or mixtures thereof.

19. A developer composition comprised of the toner composition of claim 1 and carrier particles.

20. A developer composition in accordance with claim 19 wherein the carrier particles are comprised of a ferrite, steel, or an iron powder.

21. A developer composition in accordance with claim 19 wherein the carrier particles are comprised of a core with a polymer coating thereover.

22. A developer composition in accordance with claim 21 wherein the coating is comprised of a methyl terpolymer, a polyvinylidine fluoride, a polymethylmethacrylate, or a mixture of polymers not in close proximity in the triboelectric series.

23. A method of imaging which comprises formulating an electrostatic latent on a photoreceptor, affecting development thereof with the toner composition of claim 1, and thereafter transferring the developed image to a suitable substrate.

24. A method of imaging in accordance with claim 23 wherein the transferred image is permanently fixed to the substrate.

25. A method of imaging in accordance with claim 24 wherein fixing is accomplished with a fuser roll and the charge enhancing additive selected for the toner is compatible with said fuser roll.

26. A toner composition in accordance with claim 1 wherein X is selected from the group consisting of benzyl and naphthyl.

27. A toner composition in accordance with claim 1 wherein X is p-toluene sulfonic acid, m-xylene sulfonic acid, p-xylene sulfonic acid, 1-naphthalene sulfonic acid, or 2-naphthalene sulfonic acid.

28. A toner composition in accordance with claim 1 wherein the charge enhancing additive is hexamethylene tetraamine tetratoluene sulfonate.

29. A toner composition in accordance with claim 1 further including therein a second charge enhancing additive.

30. A dry positively charged toner composition comprised of resin, pigment and a polysalt charge enhancing additive of the following formula

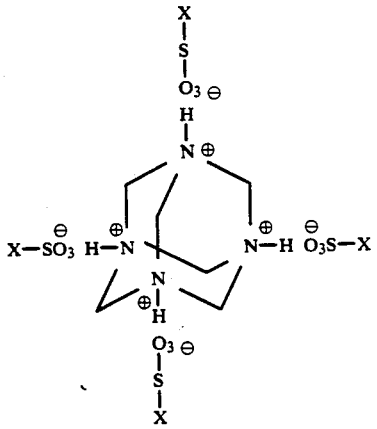
wherein X is an aromatic substituent.
* * * * *